US010405627B2

(12) United States Patent
Boland, III

(10) Patent No.: US 10,405,627 B2
(45) Date of Patent: Sep. 10, 2019

(54) LUGGAGE WITH FOLD OUT TABLE

(71) Applicant: Michael Charles Boland, III, Collingswood, NJ (US)

(72) Inventor: Michael Charles Boland, III, Collingswood, NJ (US)

( * ) Notice: Subject to any disclaimer, the term of this patent is extended or adjusted under 35 U.S.C. 154(b) by 351 days.

(21) Appl. No.: 15/207,600

(22) Filed: Jul. 12, 2016

(65) Prior Publication Data

US 2017/0013927 A1 Jan. 19, 2017

Related U.S. Application Data

(60) Provisional application No. 62/192,100, filed on Jul. 14, 2015.

(51) Int. Cl.

| | |
|---|---|
| ***A47B 5/04*** | (2006.01) |
| ***A45C 13/28*** | (2006.01) |
| ***A45C 5/14*** | (2006.01) |
| ***A45C 13/00*** | (2006.01) |
| ***A45C 13/26*** | (2006.01) |
| ***A45C 9/00*** | (2006.01) |

(52) U.S. Cl.

CPC ..... *A45C 13/28* (2013.01); *A45C 5/14* (2013.01); *A45C 9/00* (2013.01); *A45C 13/005* (2013.01); *A45C 13/262* (2013.01); *A45C 2009/002* (2013.01); *A45C 2013/267* (2013.01)

(58) Field of Classification Search

CPC .. A45C 9/00; A45C 3/02; A45C 13/02; A45C 5/00; A47B 3/10

USPC ..... 190/11, 1, 15.1, 18 A; 108/42; 280/30, 280/47.18, 37

See application file for complete search history.

(56) References Cited

U.S. PATENT DOCUMENTS

| | | | | |
|---|---|---|---|---|
| 5,529,322 | A * | 6/1996 | Barton | A45C 5/14 108/147.11 |
| 6,105,508 | A * | 8/2000 | Ryburg | A45C 7/00 108/42 |
| 6,234,085 | B1 * | 5/2001 | Ramundo | A47B 23/002 108/143 |
| 7,114,602 | B2 * | 10/2006 | Chen | A45C 13/262 190/11 |
| 7,350,857 | B2 * | 4/2008 | Bishop | A45C 9/00 190/8 |
| 8,485,327 | B1 * | 7/2013 | Dalrymple | A45C 9/00 190/11 |
| 8,613,349 | B1 * | 12/2013 | Halko | A45C 9/00 190/11 |

(Continued)

*Primary Examiner* — Fenn C Mathew
*Assistant Examiner* — Cynthia F Collado
(74) *Attorney, Agent, or Firm* — Dunlap Bennett & Ludwig PLLC

(57) ABSTRACT

A luggage having a luggage body with a fold out table is provided. The luggage body includes a top, a bottom, a front side, a rear side, a first side and a second side. The body further includes a slot formed along the rear side with an opening formed at the top leading into the slot. At least one wheel, such as a plurality of wheels are secured to the bottom of the body. A platform is slidably engaged with the slot. The platform includes a stowed position, a handle position, and a table position. The stowed position includes the platform substantially disposed within the slot, the handle position includes the platform extending from the slot and disposed vertically, and the table position includes the platform extending from the slot and disposed horizontally.

9 Claims, 4 Drawing Sheets

(56) References Cited

U.S. PATENT DOCUMENTS

| | | | | |
|---|---|---|---|---|
| 8,662,267 | B1 * | 3/2014 | Hart | A45C 5/14 190/1 |
| 9,277,796 | B1 * | 3/2016 | Elam | A45C 9/00 |
| 2005/0098402 | A1 * | 5/2005 | Cohen | A45C 5/14 190/12 A |
| 2005/0150733 | A1 * | 7/2005 | Chen | A45C 13/262 190/115 |
| 2011/0209960 | A1 * | 9/2011 | MacLean, III | A45C 5/14 190/18 A |
| 2012/0217109 | A1 * | 8/2012 | King | A45C 9/00 190/11 |
| 2014/0299428 | A1 * | 10/2014 | Gadbois | A45C 9/00 190/11 |
| 2016/0045009 | A1 * | 2/2016 | Hansborough | A45C 5/03 190/11 |
| 2016/0113388 | A1 * | 4/2016 | Distefano | A47B 5/04 108/41 |
| 2016/0235175 | A1 * | 8/2016 | Jose | A45C 13/28 |
| 2018/0132636 | A1 * | 5/2018 | Chen | A47B 23/06 |

* cited by examiner

LUGGAGE WITH FOLD OUT TABLE

CROSS-REFERENCE TO RELATED APPLICATION

This application claims the benefit of priority of U.S. provisional application No. 62/192,100, filed Jul. 14, 2015, the contents of which are herein incorporated by reference.

BACKGROUND OF THE INVENTION

The present invention relates to luggage and, more particularly, to a luggage with a fold out table.

Currently, while traveling it is very difficult to work or eat off of one's lap. The traveler has to carry extra pieces or parts to create a work surface, which adds weight and reduces bag storage capacity.

As can be seen, there is a need for luggage with a fold out table for working or eating.

SUMMARY OF THE INVENTION

In one aspect of the present invention, a luggage comprises: a body comprising a top, a bottom, a front side, a rear side, a first side and a second side, wherein an internal compartment is formed therebetween and a slot formed along the rear side, wherein an opening is formed at the top leading into the slot; at least one wheel secured to the bottom; a platform slidably engaged with the slot, wherein the platform comprises a stowed position, a handle position, and a table position, wherein the stowed position comprises the platform substantially disposed within the slot, the handle position comprises the platform extending from the slot and disposed vertically, and the table position comprises the platform extending from the slot and disposed horizontally.

In another aspect of the present invention, a luggage comprises: a body comprising a top, a bottom, a front side, a rear side, a first side and a second side, wherein an internal compartment is formed therebetween and a slot formed along the rear side, wherein an opening is formed at the top leading into the slot; a plurality of wheels secured to the bottom; a platform slidably engaged with the slot and comprising a handle opening formed at a distal end; and a locking hinge secured adjacent to the opening of the slot, wherein the platform comprises a stowed position, a handle position, and a table position, wherein the stowed position comprises the platform substantially disposed within the slot, the handle position comprises the platform extending from the slot and disposed vertically, and the table position comprises the platform extending from the slot and disposed horizontally, and the locking hinge is locked in the handle position and unlocked to allow the platform to pivot from the handle position to the table position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a rolling luggage having an extending handle that converts to a table. The luggage of the present invention provides a work surface where no other work surfaces are available. The present invention includes a table and support which are lightweight and take up very little space from storage in the bag. The table of the present invention may be built into the extended handle.

Figure 1:
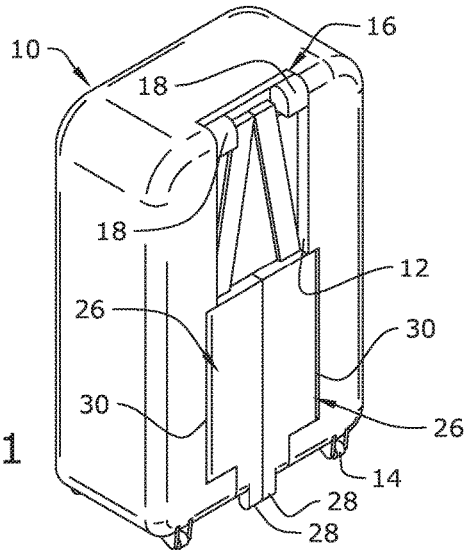
FIG. 1 is a rear top perspective view of the present invention shown in an exemplary initial configuration.
Figure 2:
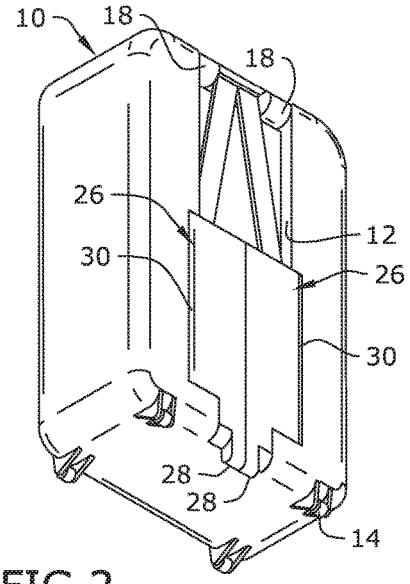
FIG. 2 is a rear bottom perspective view of the present invention shown in an exemplary initial configuration.
Figure 3:
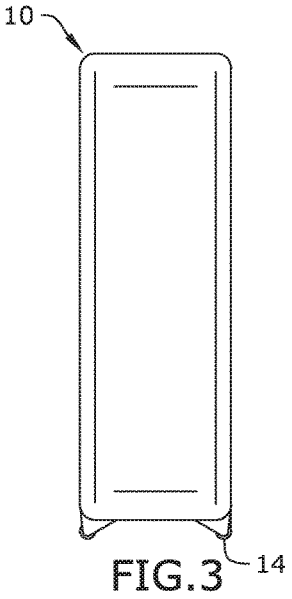
FIG. 3 is a side view of the present invention shown in an exemplary initial configuration.
Figure 4:
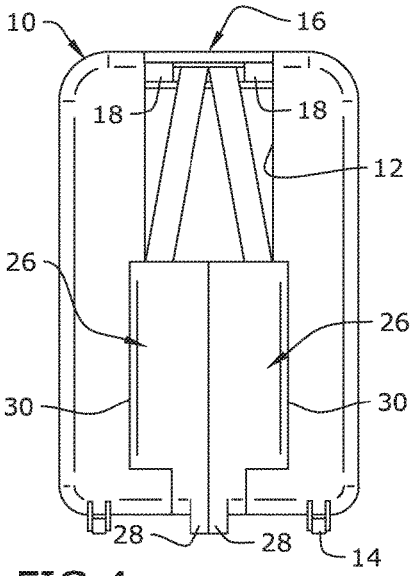
FIG. 4 is a rear view of the present invention shown in an exemplary initial configuration.
Figure 5:
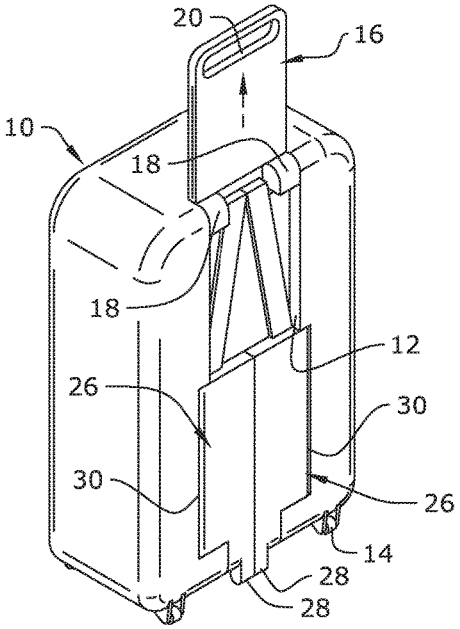
FIG. 5 is a rear top perspective view of the present invention shown with a platform extended outwards.
Figure 6:
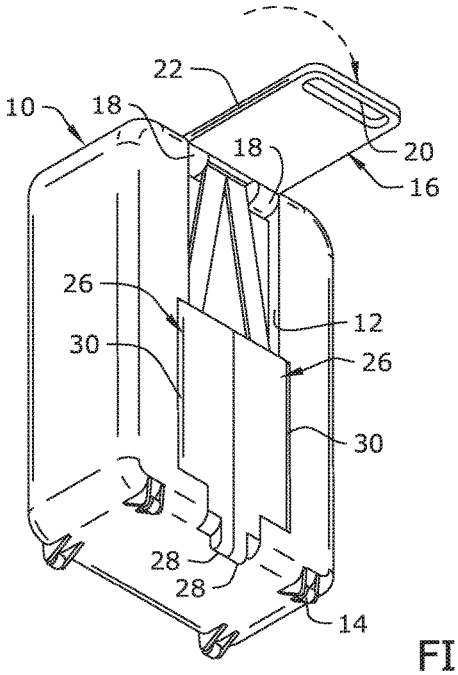
FIG. 6 is a rear bottom perspective view of the present invention shown with the platform pivoted 90 degrees.
Figure 7:
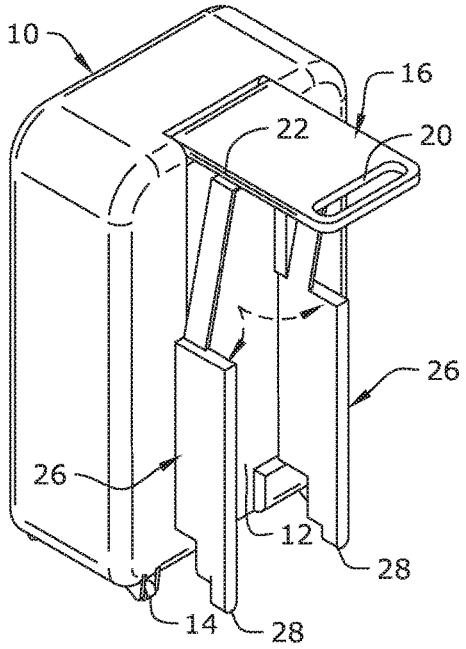
FIG. 7 is a rear top perspective view of the present invention shown with the platform pivoted 90 degrees and support legs pivoted 90 degrees.
Figure 8:
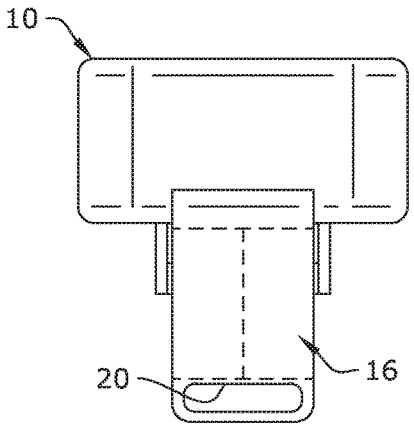
FIG. 8 is a top view of the present invention shown with the platform pivoted 90 degrees and support legs pivoted 90 degrees.
Figure 9:
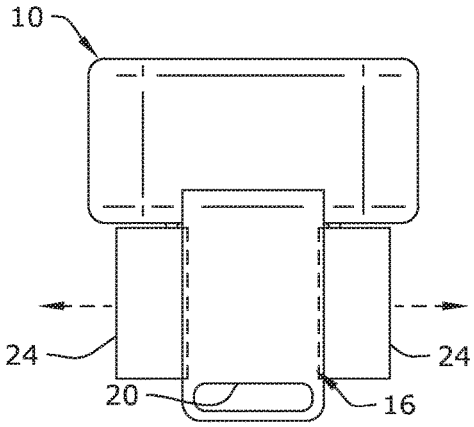
FIG. 9 is a top view of the present invention shown with the platform pivoted 90 degrees and internal platforms extending from the platform.
Figure 10:
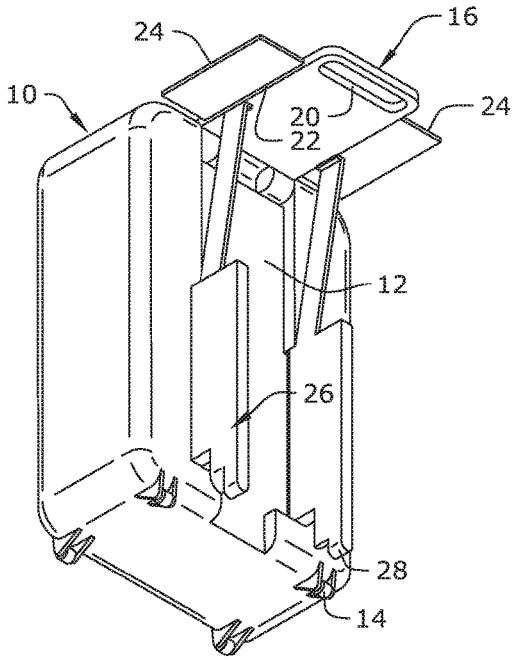
FIG. 10 is a rear bottom perspective view of the present invention shown with the platform pivoted 90 degrees and internal platforms extending from the platform.
Figure 12:
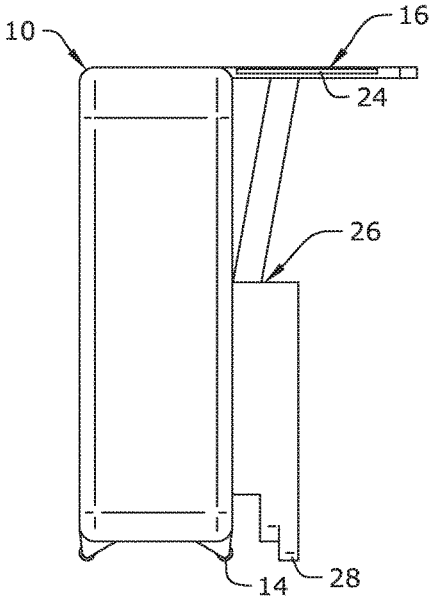
FIG. 12 is a side view of the present invention shown with the platform pivoted 90 degrees and internal platforms extending from the platform.
Figure 11:
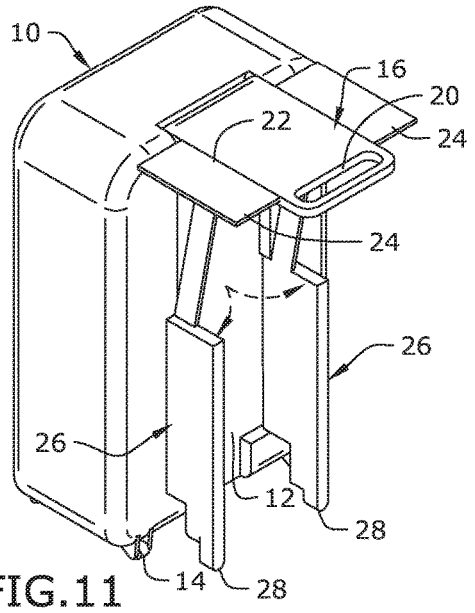
FIG. 11 is a rear top perspective view of the present invention shown with the platform pivoted 90 degrees and internal platforms extending from the platform.

Referring to FIGS. 1 through 12, the present invention includes a luggage having a luggage body 10. The luggage body 10 includes a top, a bottom opposite the top, a front side, a rear side opposite the front side, a first side and a second side opposite the first side. The body 10 forms an internal compartment within to store travel goods. The body 10 further includes a slot formed along the rear side with an opening formed at the top leading into the slot. At least one wheel 14, such as a plurality of wheels 14 are secured to the bottom of the body 10. A platform 16 is slidably engaged with the slot. The platform 16 includes a stowed position, a handle position, and a table position. The stowed position includes the platform 16 substantially disposed within the slot, the handle position includes the platform 16 extending from the slot and disposed vertically, and the table position includes the platform 16 extending from the slot and disposed horizontally.

The platform 16 of the present invention includes a distal end and a proximal end. The distal end may include a handle opening 20. Therefore, when the platform 16 is in the handle position a user may grab the handle 20 and pull or push the luggage. The platform 16 may further include a pair of pegs extending for opposing sides of the proximal end. The pair of pegs slidably engage within channels that are formed within the slot. The pegs of the platform 16 slide along the internal channels when transitioning from the stowed position to the handle position.

The present invention may utilize a locking hinge 18 to transition the platform 16 from the handle position to the table position. The locking hinge 18 may be secured to the luggage body 10 adjacent to the opening of the slot. When the user pulls the platform 16 out of the slot to the handle position, the platform 16 may be locked in the handle position. The user may then engage a button to unlock the locking hinge 18, which allows the platform 16 to pivot about 90 degrees to the horizontal position. The locking hinge 18 may lock the platform 16 in place in the table position.

In certain embodiments, the present invention may further include supports for the platform 16 in the table position. At least one leg 26 may pivot out and support the platform 16. The at least one leg 26 may include a top end that engages the platform 16 and a foot 28 that rests against the ground. In certain embodiments, a recess 12 may be formed along the rear side of the body 10 from the top to the bottom. A first leg 26 and a second leg 26 are each pivotally secured within the recess 12 by a hinge 30. The first leg 26 and the second leg 26 include a stowed position and a deployed position. The stowed position includes the first leg 26 and the second leg 26 substantially within the recess. The deployed position includes the first leg 26 and the second leg 26 pivoted about 90 degrees out of the recess and supporting the platform 16 in the table position.

In certain embodiments, the platform 16 may be expandable to expand the working surface. The platform 16 may include a first platform slot 22 and a second platform slot 22 formed along opposing edges. A first extending platform 24 may be disposed within the first platform slot 22 and a second extending platform 24 may be disposed within the second platform slot 22. In the table position, a user may slide the extending platform 24 out of their respective platform slots 22 to increase the working space of the platform.

A traveler can use this bag as a normal roller board or suite case, or it can be modified to be used as a portable work surface. With the handle fully extended in travel mode, the hinge can be activated and the handle moved to be parallel with the floor creating a portable work surface. If the handle is bent to be behind the bag, the built in supports can be moved into position and the extending platforms can be extended for work station mode. Once ready to begin travelling, the extending platforms are pushed into the slots, the handle is rotated about 90 degrees and pushed into the bag slot and the support legs tucked into the recess formed in the luggage.

It should be understood, of course, that the foregoing relates to exemplary embodiments of the invention and that modifications may be made without departing from the spirit and scope of the invention as set forth in the following claims.

What is claimed is:

1. A luggage comprising:

a body comprising a top, a bottom, a front side, a rear side, a first side, and a second side, wherein an internal compartment is formed therebetween and a slot is formed along the rear side, wherein an opening is formed at the top leading into the slot and a recess is formed along the rear side of the body from the top to the bottom;

at least one wheel secured to the bottom;

a platform slidably engaged with the slot, wherein the platform comprises a stowed position, a handle position, and a table position, wherein the stowed position comprises the platform substantially disposed within the slot, the handle position comprises the platform extending from the slot and disposed vertically, and the table position comprises the platform extending from the slot, pivoting away from the body, and disposed horizontally.

2. The luggage of claim 1, further comprising a locking hinge secured adjacent to the opening of the slot, wherein the locking hinge is locked in the handle position and unlocked to allow the platform to pivot from the handle position to the table position.

3. The luggage of claim 1, wherein the platform comprises a handle opening formed at a distal end.

4. The luggage of claim 1, further comprising a first leg and a second leg each pivotally secured within the recess, wherein the first leg and the second leg comprise a stowed position and a deployed position, the stowed position comprising the first leg and the second leg substantially within the recess and the deployed position comprising the first leg and the second leg pivoted out of the recess and the platform resting on top ends of the first leg and the second leg in the table position.

5. The luggage of claim 1, wherein the at least one wheel is a plurality of wheels.

6. The luggage of claim 1, further comprising at least one internal platform slidably engaged within a platform slot of the platform, wherein the at least one internal platform is operable to laterally extend from the platform slot.

7. A luggage comprising:

a body comprising a top, a bottom, a front side, a rear side, a first side, and a second side, wherein an internal compartment is formed therebetween and a slot is formed along the rear side, wherein an opening is formed at the top leading into the slot and a recess is formed along the rear side of the body from the top to the bottom;

a plurality of wheels secured to the bottom;

a platform slidably engaged with the slot and comprising a handle opening formed at a distal end; and a locking hinge secured adjacent to the opening of the slot, wherein the platform comprises a stowed position, a handle position, and a table position, wherein the stowed position comprises the platform substantially disposed within the slot, the handle position comprises the platform extending from the slot and disposed vertically, and the table position comprises the platform extending from the slot, pivoting away from the body, and disposed horizontally, and the locking hinge is locked in the handle position and unlocked to allow the platform to pivot from the handle position to the table position.

8. The luggage of claim 7, further comprising a first leg and a second leg each pivotally secured within the recess, wherein the first leg and the second leg comprise a stowed position and a deployed position, the stowed position comprising the first leg and the second leg substantially within the recess and the deployed position comprising the first leg and the second leg pivoted out of the recess and supporting the platform in the table position.

9. The luggage of claim 7, further comprising at least one internal platform slidably engaged within a platform slot of the platform, wherein the at least one internal platform is operable to laterally extend from the platform slot.

* * * * *